US007416449B2

(12) United States Patent
Kuo et al.

(10) Patent No.: US 7,416,449 B2
(45) Date of Patent: Aug. 26, 2008

(54) ELECTRICAL CONNECTOR ASSEMBLY WITH IMPROVED COVERS

(75) Inventors: Peter Kuo, Tu-cheng (TW); Hou-Yu Shi, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/888,794

(22) Filed: Aug. 2, 2007

(65) Prior Publication Data

US 2008/0032554 A1 Feb. 7, 2008

(30) Foreign Application Priority Data

Aug. 20, 2006 (CN) ..... 2006 2 0075530

(51) Int. Cl.
*H01R 13/648* (2006.01)

(52) U.S. Cl. ..... 439/610; 439/931

(58) Field of Classification Search ..... 439/92, 439/95, 108, 607–610, 931, 939
See application file for complete search history.

(56) References Cited

U.S. PATENT DOCUMENTS 5,217,394 A * 6/1993 Ho ..... 439/620.21
5,477,421 A * 12/1995 Bethurum ..... 361/818
5,546,278 A * 8/1996 Bethurum ..... 361/737
5,739,500 A * 4/1998 Van Beers ..... 219/117.1
6,033,263 A * 3/2000 Weidler et al. ..... 439/620.1
7,074,057 B2 * 7/2006 Chiran et al. ..... 439/92
7,086,889 B2 8/2006 Yin
2008/0032554 A1 * 2/2008 Kuo et al. ..... 439/607
2008/0032560 A1 * 2/2008 Shi et al. ..... 439/638
2008/0038959 A1 * 2/2008 Barringer et al. ..... 439/607

* cited by examiner

*Primary Examiner*—James Harvey
(74) *Attorney, Agent, or Firm*—Wei Te Chung

(57) ABSTRACT

An electrical connector assembly includes a first connector unit comprising a first insulative housing and a first metal shielding covering the first housing, a second connector unit comprising a second insulative housing and a second metal shielding covering the second housing, a PCB respectively connect with the first and second connector units, and an insulative casing covering said first and second connector units and consisting of an upper cover and a lower cover engaged with each other. The casing forms a number of slices extending along the up-to-lower direction and a number of slots adapted for receiving said slices to joint the upper and lower covers together. Inner surfaces of the upper and lower covers are gilt with a thin layer, and the inner gilt surfaces of the upper and lower covers and the first and second metal shieldings define a shielded and generally close space to cover the first and second housings.

11 Claims, 7 Drawing Sheets

ELECTRICAL CONNECTOR ASSEMBLY WITH IMPROVED COVERS

BACKGROUND OF THE INVENTION

1. Field of the Invention

The present invention relates to an electrical connector assembly, and more particularly to a connector assembly having an upper and lower shielded covers which can save space and reduce product size to meet light, thin, short and compact current trend.

2. Description of the Prior Art

U.S. Pat. No. 7,086,889 discloses a connector assembly whose insulative casing includes a lower cover and an upper cover engaged with each other. A plurality of upwardly slices extend beyond the side walls of the lower cover, and a plurality of slots are defined along the side walls of the upper cover corresponding to the configuration of the slices such that the slices are received in the slots to joint the lower and upper covers together. The shortcoming is that the insulative casing can't protect signal transmission of terminals therein and therefore, it doesn't have good electrical properties.

BRIEF SUMMARY OF THE INVENTION

A main object of the present invention is to provide an improved electrical connector assembly having an upper and lower shielded covers which can save space and reduce product size to meet light, thin, short and compact current trend.

To fulfill the above-mentioned objects, an electrical connector assembly according to the present invention comprises a first connector unit comprising a first insulative housing and a first metal shielding covering the first housing, a second connector unit comprising a second insulative housing and a second metal shielding covering the second housing, a PCB respectively connect with the first and second connector units, and an insulative casing covering said first and second connector units and consisting of an upper cover and a lower cover engaged with each other. The casing forms a plurality of slices extending along the up-to-lower direction and a plurality of slots adapted for receiving said slices to joint the upper and lower covers together. Inner surfaces of the upper and lower covers are gilt with a thin layer, and the inner gilt surfaces of the upper and lower covers and the first and second metal shieldings define a shielded and generally close space to receive the first and second housings.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
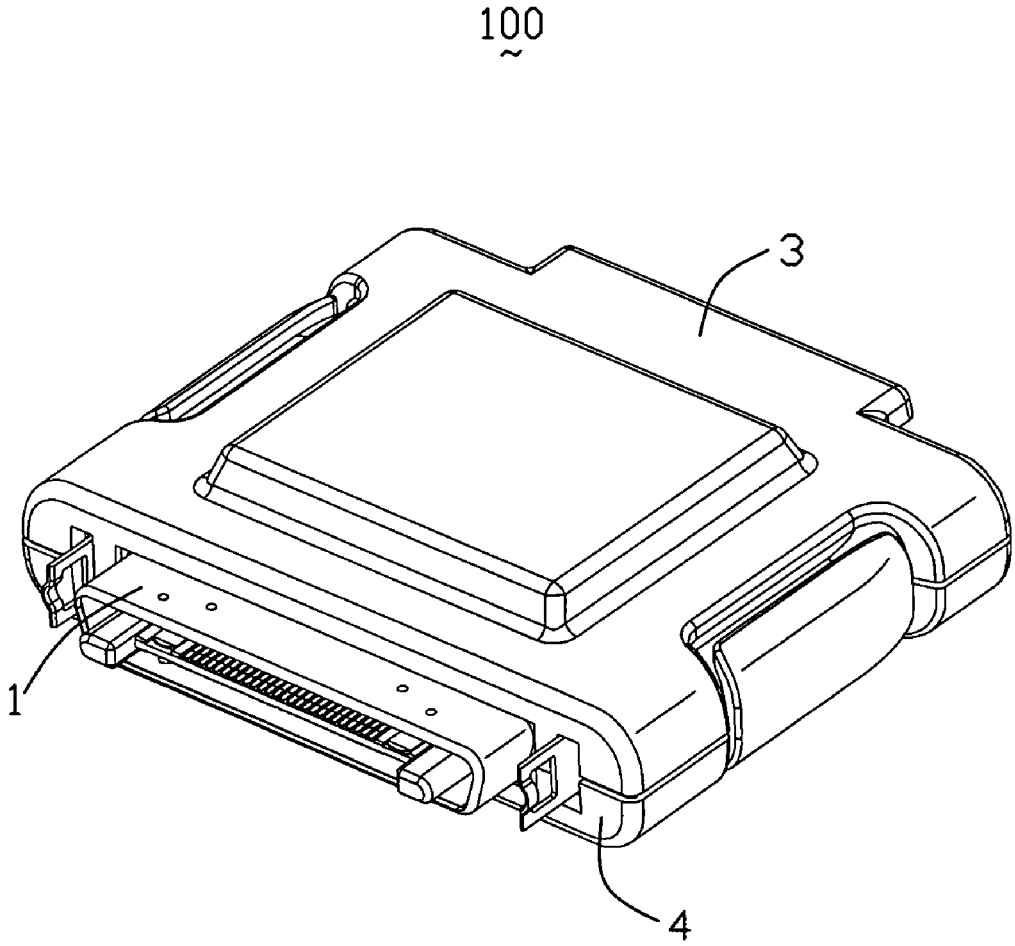
FIG. 1 is a perspective view of an electrical connector assembly according to the present invention.
Figure 2:
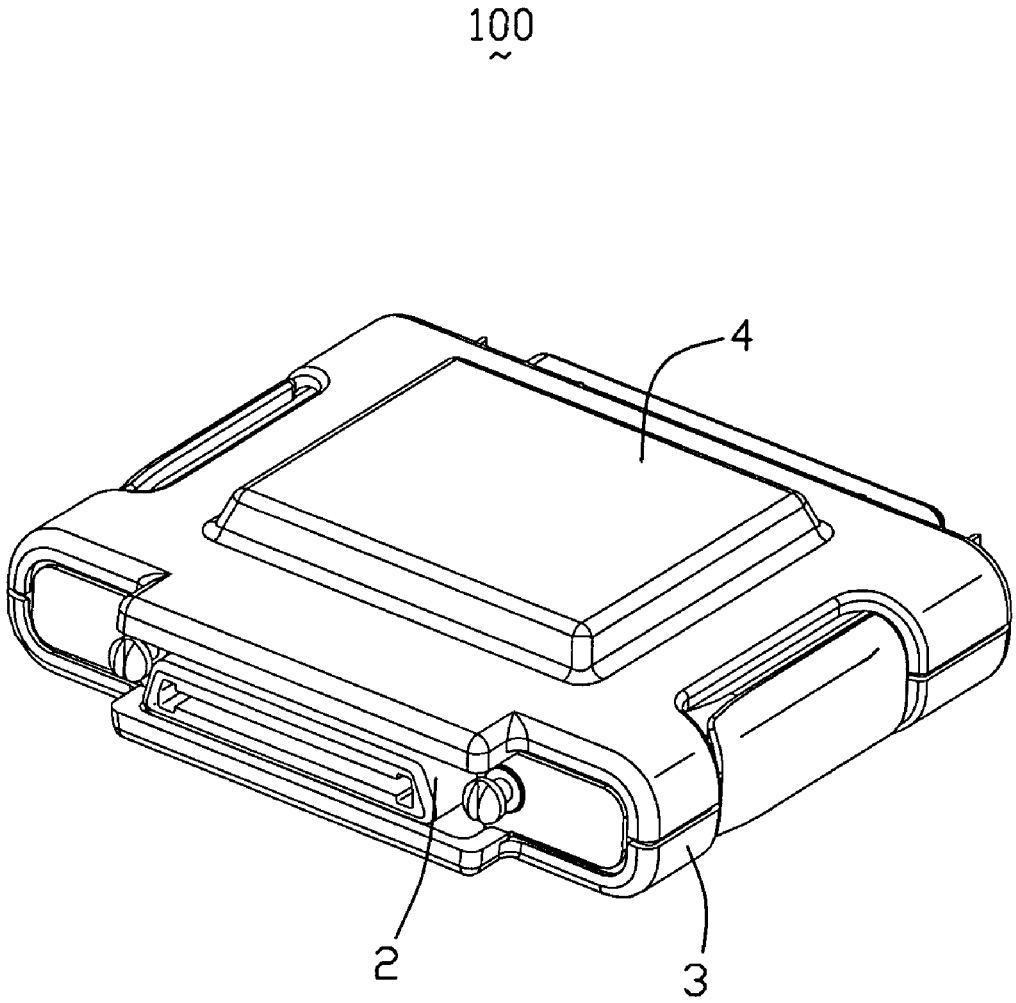
FIG. 2 is a view similar to FIG. 1, but viewed from another aspect.
Figure 4:
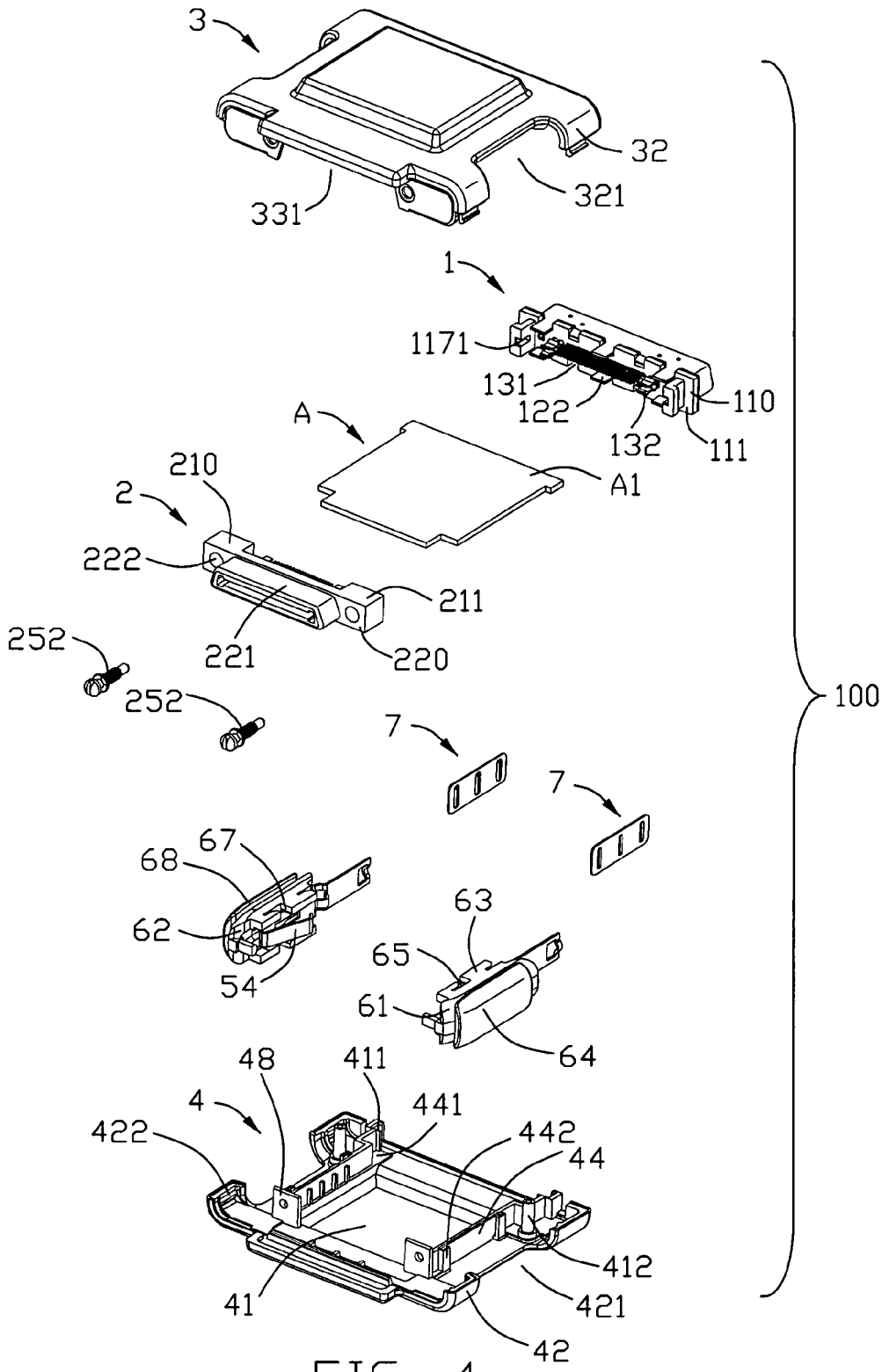
FIG. 4 is a view similar to FIG. 3, but viewed from another aspect.
Figure 5:
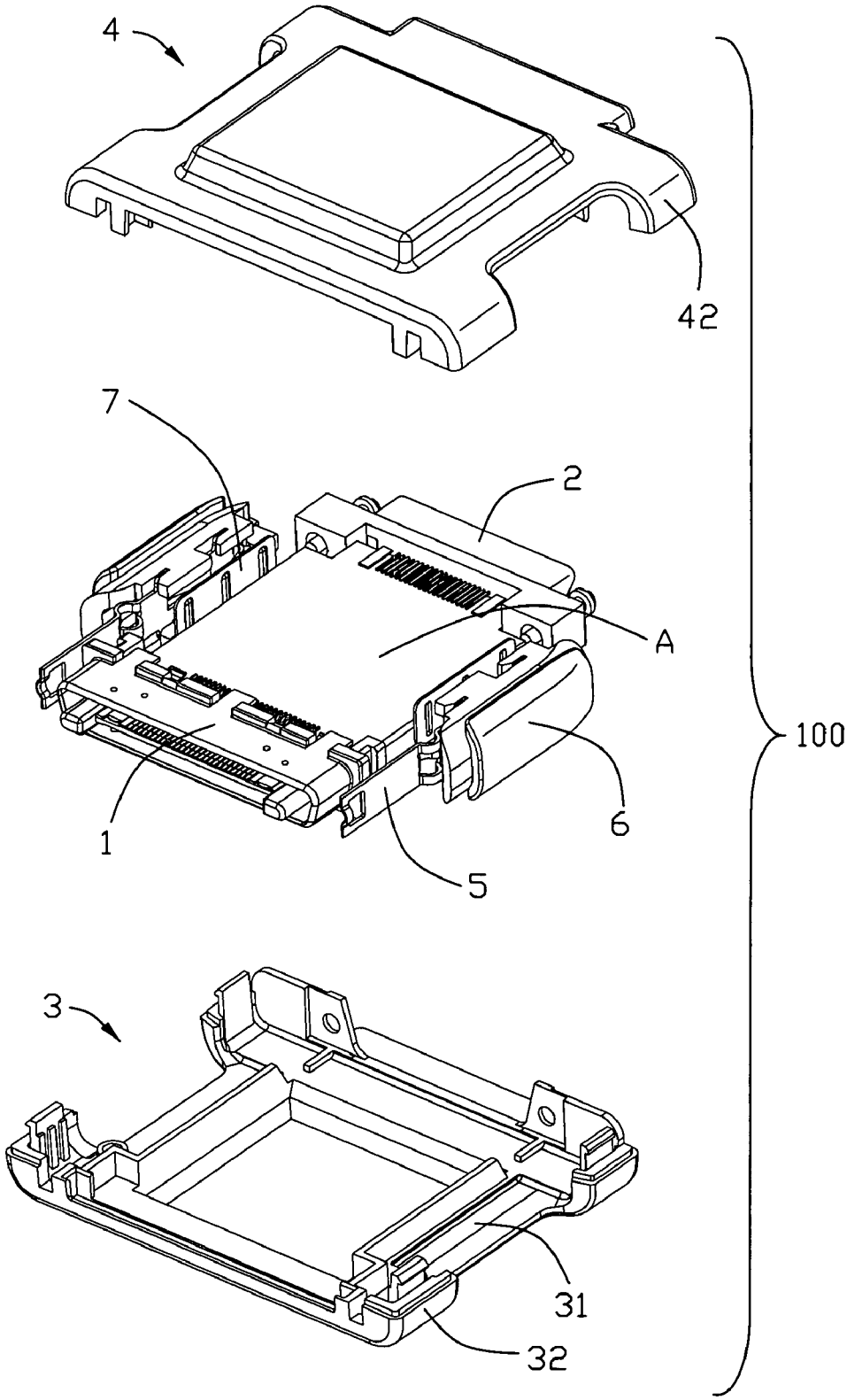
FIG. 5 is a partially, exploded view of the electrical connector of FIG. 1, wherein an upper and lower covers are farther taken away for explicitly showing internal structure of the upper and lower covers.
Figure 6:
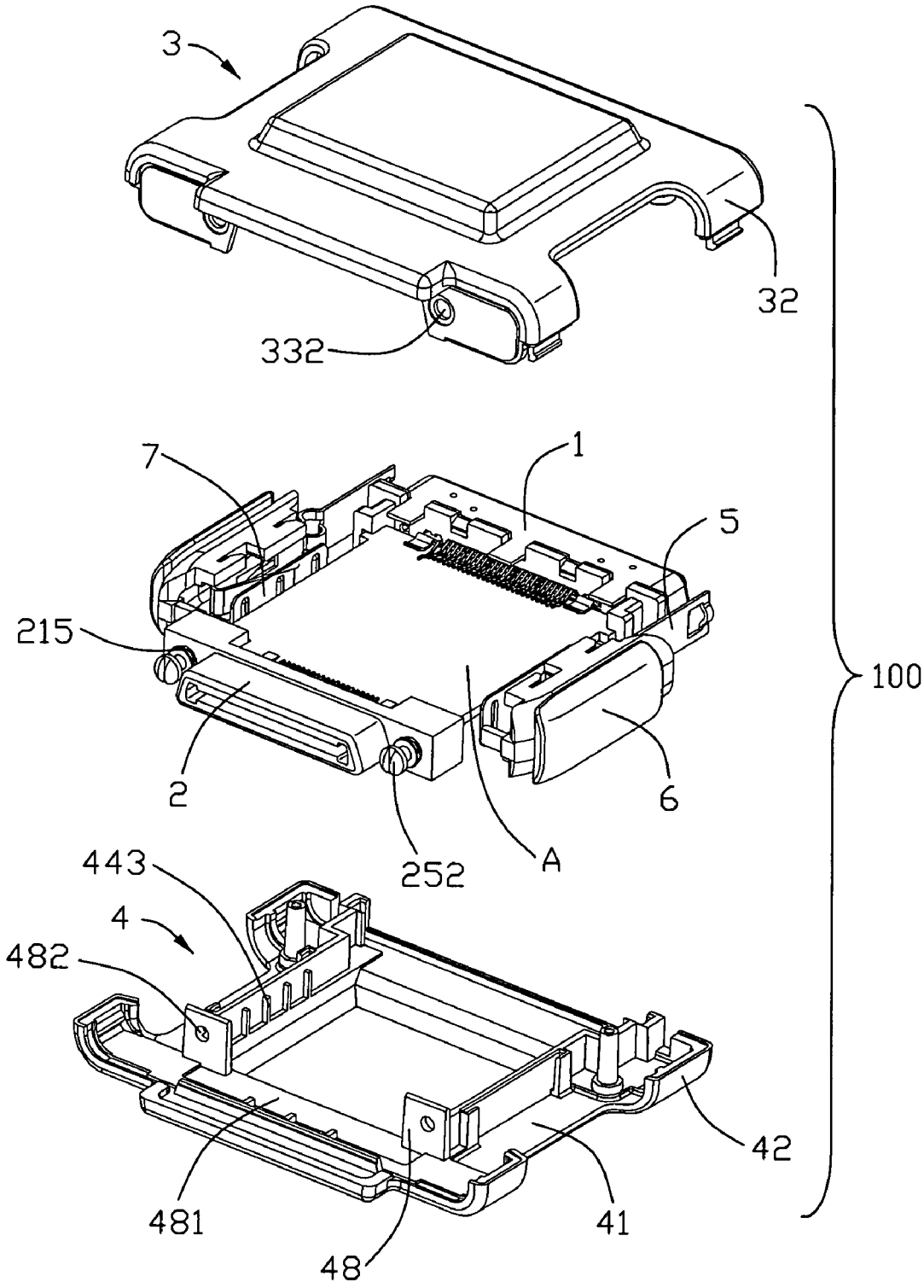
FIG. 6 is a view similar to FIG. 5, but viewed from another aspect.

Referring to the drawings in greater detail, and first to FIGS. 1 and 4, an electrical connector assembly 100 according to the present invention comprises an insulative casing, a first connector unit 1, a second connector unit 2, a printed circuit board A and a pair of interlocking members. In the preferred embodiment, the electrical connector assembly 100 is an electrical adapter adapted for realizing electrical connection between a Notebook and a docking station. Furthermore, the insulative casing is a rectangular contour and includes a lower cover 4 and an upper cover 3 engaged with each other which together define a receiving space (not labeled) therebetween. The receiving space is provided with a first opening (not labeled) occupied by the first connector unit 1 and a second opening (not labeled) occupied by the second connector unit 2. The detail description will be discussed hereinafter.

Figure 3:
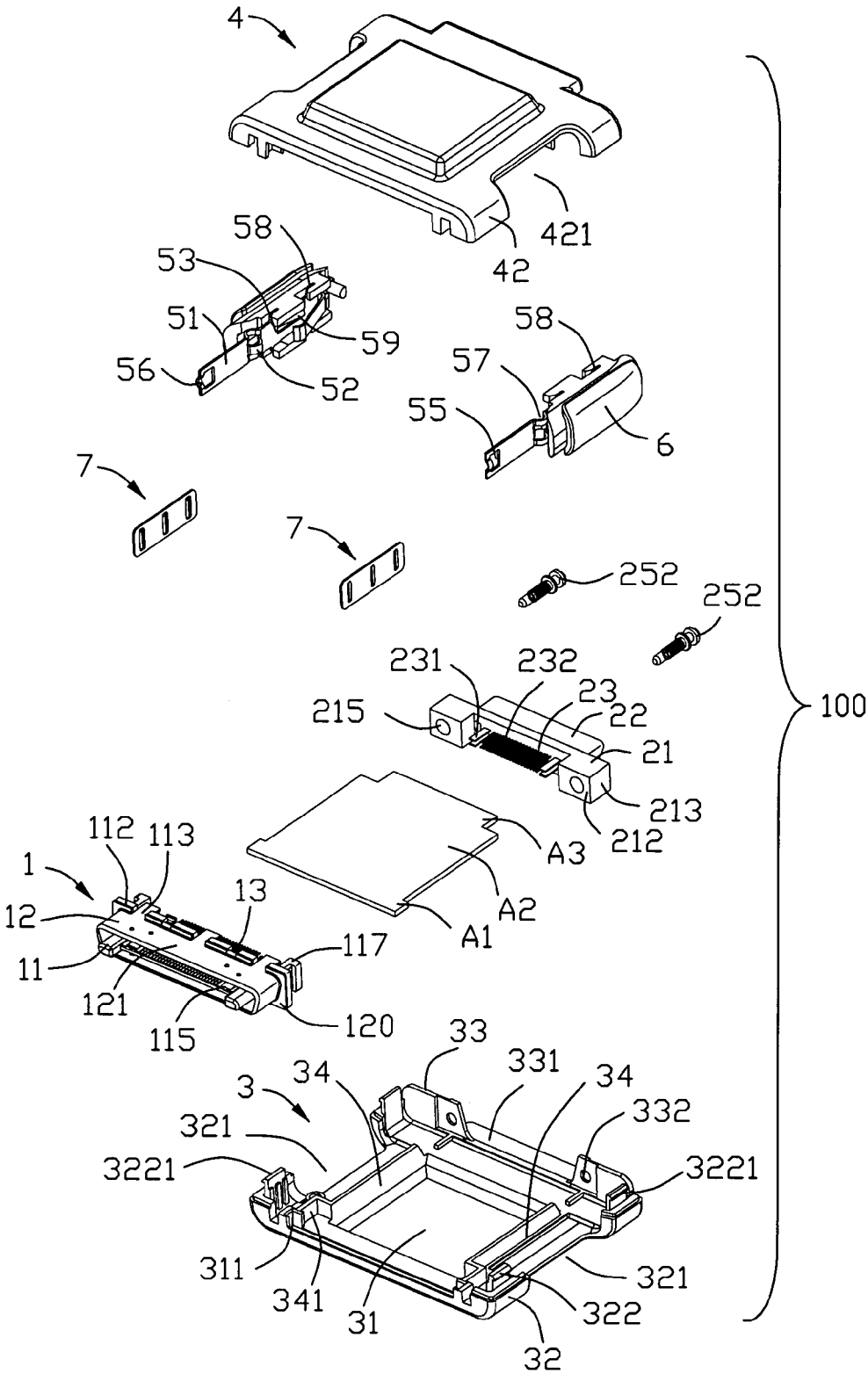
FIG. 3 is an exploded, perspective view of FIG. 1.

Referring to FIGS. 3-4, the first connector unit 1 is of male type and includes a first insulative housing 11, a first metal shielding 12 and a first conductive terminal set 13. The first insulative housing 11 has a longitudinal base 110 which defines a mating surface (not shown, hidden by the first metal shielding 12), a joint surface 111 opposite to the mating surface and a pair of top and bottom surfaces 112 opposite to each other and interconnected with the mating surface and the joint surface 111. The top and bottom surfaces 112 define a plurality of recesses 113 through the mating surface and the joint surface 111. The mating surface forms a generally D-shaped protrusion (not shown, hidden by the first metal shielding 12 and similar to D-shaped protrusion 114 in U.S. Pat. No. 7,086,889) forwardly extending from a middle region thereof, in sequence, a mating tongue 115 forwardly extends from a middle region of the protrusion 114. A plurality of passageways (not labeled) are defined through the mating tongue 115 to receive the first conductive terminal set 13. A pair of spaced L-shaped arms 117 rearwardly and outwardly extend from opposite sides of the joint surface wherein a space between the arms 117 is equal to the width of front edge of the print circuit board A. The first metal shielding 12 is affixed to the insulative housing 11 and includes a flat plate 120 attaching to the mating surface, a D-shaped mating frame 121 forwardly extending from the flat plate 120 to enclose the protrusion and the mating tongue 115, and a plurality of tail plates 122 rearwardly extending from top and bottom surfaces of the mating frame 121 corresponding to the recesses 113 for engagement therewith. The first terminal set 13 is arranged in upper and lower rows to be received in corresponding passageways of the mating tongue 115 and includes a plurality of signal terminals 131 spaced from each other at middle region thereof for signal transmission and a plurality of power terminals 132 distributed at outmost thereof for power transmission, wherein there are two pairs of the power terminals 132 and the power terminals 132 have larger width than that of the signal terminals 131 in accordance with the preferred embodiment of the present invention. Each of the first terminal set 13 is generally straight in shape and has a contacting portion (not labeled) adapted for electrical connection with a corresponding contact of a mating connector (not shown) and a tail portion (not labeled) adapted for electrical connection with the printed circuit board A by known process such as soldering etc.

The second connector unit 2 is of female type and includes a second insulative housing 21, a second metal shielding 22, a second conductive terminal set 23 and a pair of fastening members. The second insulative housing 21 has a longitudinal body 210 defining upper and bottom surfaces 211 opposite to each other, a front surface (not shown, hidden by the second metal shielding 22), a rear surface 212 and a pair of side surfaces 213. A D-shaped nose portion (not shown, hidden by the second metal shielding 22) forwardly extends from middle region of the front surface of the second insulative housing 21 and defines a plurality of grooves (not labeled) at upper and lower inner walls thereof for receiving the second terminal set 23 therein. A pair of body holes 215 spaced by the nose portion are defined adjacent to opposite side surfaces 213 and respectively extend through the front surface and the rear surface 212. The second metal shielding 22 is affixed to the second insulative housing 21 and includes a blade plate 220 covering the front surface of the insulative housing 21, a mating skeleton 221 forwardly extending from the blade plate 220 to enclose the nose portion 214, and a pair of blade holes 222 aligning with the body holes 215 for uniformities therewith. The second terminal set 23 is arranged in upper and lower rows to be received in the grooves and includes a plurality of signal terminals 231 spaced from each other at middle region thereof and a plurality of power terminals 232 distributed at outmost thereof. Each of the second terminal set 23 has a mating portion (not labeled) adapted for electrical connection with a corresponding contact of a mating connector (not shown) and a solder portion adapted for electrical connection with the printed circuit board A. The fastening members are respectively assembled to opposite sides of the second connector unit 2 and include a cylindrical tube (not shown, received in the body holes 215 and affixed to inner sides of the body holes 215) defining a screw hole therein and a bolt 252 adapted for screwing into the screw hole.

The printed circuit board (PCB) A has a plurality of conductive pads (not shown) located at opposite ends thereof and electrically communicated with the first terminal set 13 and the second terminal set 23. The PCB A comprises a main portion A2 in the middle thereof, an expanding portion A1 at a front end thereof and a narrow portion A3 at a rear end thereof. The pair of L-shaped arms 117 of the first connector unit 1 defines at middle region thereof a groove 1171 to receive and hold the expanding portion A1 of the PCB A. The narrow portion A3 is received in a space (not labeled) between the pair of body holes 215.

Referring to FIGS. 3-6, the upper and lower covers 3 and 4 are made of insulative material and respectively have a main wall 31, 41 and a pair of side walls 32, 42 extending from opposite sides of the main wall 31, 41. The main walls 31, 41 respectively protrude a pair of shoulder portions 311, 411 adjacent to the side walls 32, 42 for commonly securing the base 110 of the first connector unit 1, and a pair of elongated partitions 34, 44 along the side walls 32, 42 for commonly securing the printed circuit board A in position. Each of the partitions 34, 44 has a stepped mounting edge 341, 441 at front edge thereof for abutting against the arm 117 of the first connector unit 1 and the expanding portion A2 of the printed circuit board A. The lower and upper covers 3, 4 respectively define a pair of notches 321, 421 at opposite side walls 32, 42 for being assembled with the interlocking members. A plurality of upright slices 322 each including a hook 3221 at a free end thereof extend beyond the side walls 32 of the upper cover 3, and a plurality of slots 422 are defined along the side walls 42 of the lower cover 4 corresponding to the configuration of the slices 322 such that the slices 322 are received in the slots 422 to joint the upper and lower covers 3 and 4 together. Furthermore, the lower cover 4 forms two pairs of protrusions 442 in lengthwise direction along outside of corresponding partitions 44 and a pair of dowel posts 412 in lateral direction near the partitions 44, wherein a distance between the pair of protrusions 442 in lengthwise direction is generally equal to length of corresponding notch 421. A distance between the pair of partitions 44 of the lower cover 4 is larger than that of the pair of partitions 34 of the upper cover 3, and the main portion A2 of the printed circuit board A is received between the pair of partitions 44 and locate on a top surface of the pair of partitions 34.

In addition, the main wall 31 of the upper cover 3 extends upwards to form a first vertical wall 33. The first vertical wall 33 comprises in the middle thereof a D-shaped opening 331 to accommodate the second connector unit 2 and a pair of through-holes 332 located on both sides thereof and aligning with the body holes 215 of the second connector unit 2. A second vertical wall 48 of the lower cover 4 is formed parallel to the first vertical wall 33 and in connection with the partitions 44, and comprises in the middle thereof a rectangular opening 481 to accommodate the narrow portion A3 of the PCB A and a pair of through-holes 482 located on both sides thereof and aligning with the body holes 215 of the second connector unit 2. When assembled, the through-holes 332 of the upper cover 3, the body holes 215 of the second connector unit 2 and the through-holes 482 of the lower cover 4 stay in a line to insert the bolt 252 into.

Figure 7:
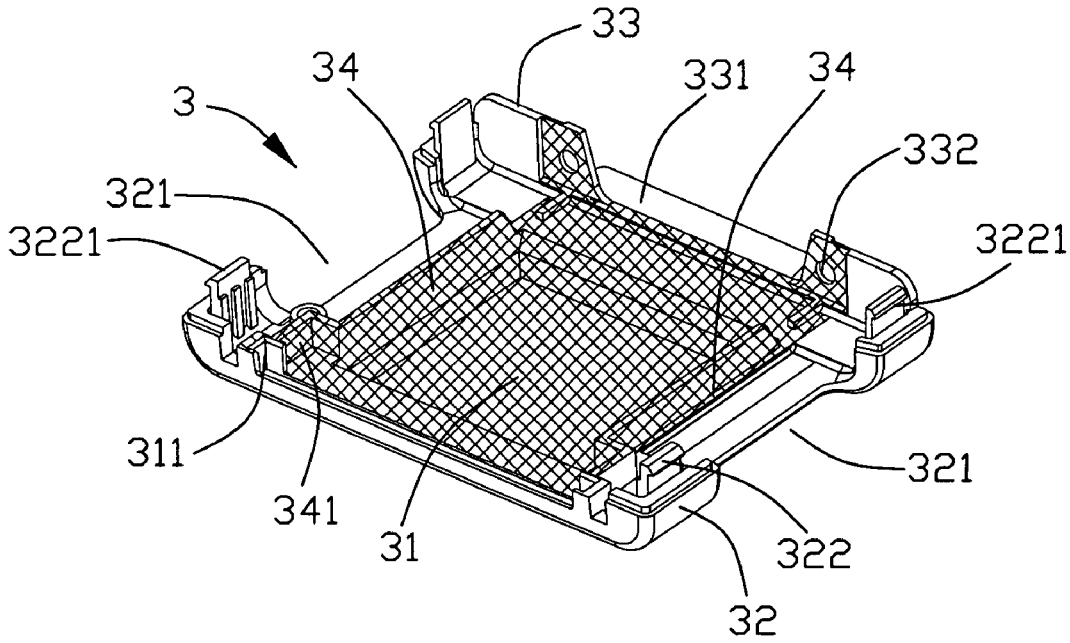
FIG. 7 is an exploded view of the upper and lower covers of the electrical connector assembly for explicitly showing gilt regions.
Figure 7:
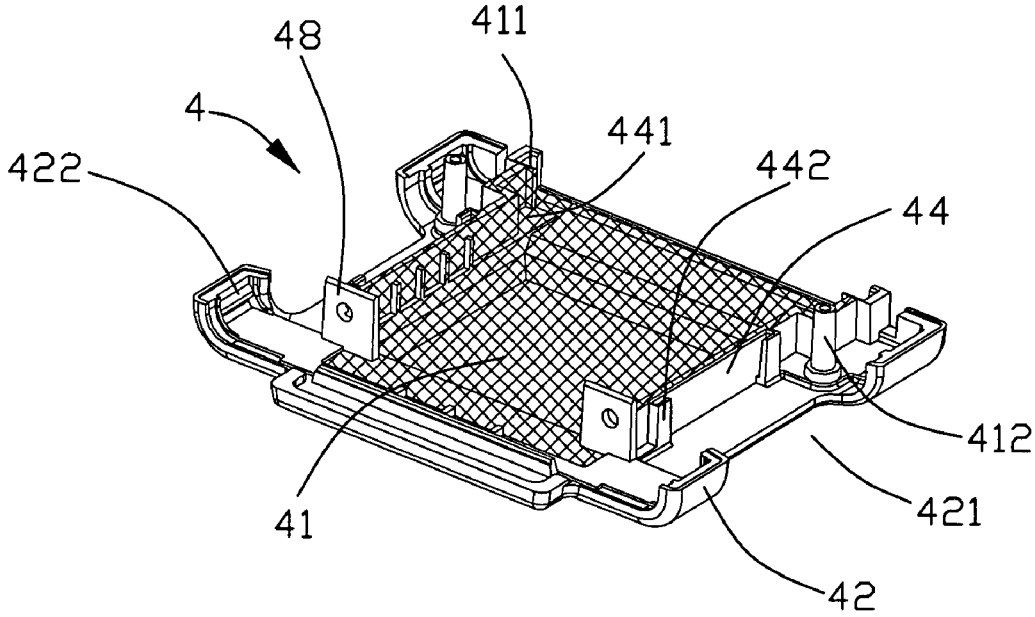

Referring to FIG. 7, the upper and lower covers 3 and 4 are respectively covered with a thin layer of metal for protecting signal transmission between the first connector unit 1 and the second connector unit 2 from external electromagnetic interference. In the preferred embodiment, firstly, the upper and lower covers 3 and 4 are respectively gilt with a plating copper layer by Vacuum sputter system, and then the outer surface of the plating copper layer is covered with stainless steel layer. This gilt casing can replace a metal shell to avoid external electromagnetic interference and save space, reduce product size to meet light, thin, short and compact trend of development.

To achieve better shielding effect, a region of inner surfaces of the main walls 31 and 41 covering the first and second connector units 1 and 2 and painted with reticular lines in FIG. 7 will be gilt. A surface of the first vertical wall 33 will be also gilt to communicate with the second metal shielding 22 and other gilt portions of the upper cover 3 when the second connector unit 2 is assembled. Then the bolts 252 are inserted into the cylindrical tubes which are affixed to inner sides of the body holes 215, so that the bolts 252, cylindrical tubes, the second metal shielding 22 and the main wall 31 constitute an access road. When mating, the bolts 252 electrically connect with a grounding element of a complement connector to achieve grounding. Tail plates 122 of the first metal shielding 12 physically connect the main walls 31 and 41 and electrically link the upper and lower covers 3 and 4.

The interlocking members are assembled to the upper and lower covers 3, 4 and each includes a latch member 5, a press member 6 and an enforcement plate 7. The latch member 5 is an elongated metal plate and includes a hook portion 51 at one end thereof for engagement with appropriate latch means of the complementary mating connector (not shown), a middle portion 52 defining a dowel slot 57 corresponding to the dowel post 412 of the upper cover 3, a retention portion 53 formed with a plurality of stators 58 on opposite sides thereof, and a resilient portion 54 obliquely and inwardly extending from the retention portion 53. Furthermore, the retention portion 53 has an outward spring 59 opposite to the resilient portion 54. The press member 6 includes a main portion 61, a pair of opposite sides 62 extending from the main portion 61, a plurality of flanges 63 formed on the sides 62, a plurality of wedged slits 65 defined between the flanges 63 and the sides 62 to interferely fit with the stators 58 of the latch member 5, and an operating portion 64 coving the main portion 61 to define a generally cartouche shaped surface for engagement by an operator's thumb or finger. Furthermore, the main portion 61 and the opposite sides 62 commonly define a channel 67 therebetween. An inclined projection (not shown) is formed along the channel 67 to support the spring 59 of the latch member 5. A pair of elongated stoppers 68 go over edges of the main portion 61 for preventing the interlocking members from been overpressed. The enforcement plates 7 are inserted into gaps defined between the lengthwise protrusions 442 and the partitions 44, wherein the length of the enforcement plate 7 is generally equal to the distance between the lengthwise protrusions 442.

When the interlocking members are assembled in position, the press members 6 are exposed out of the notches 321, 421, and the latch members 5 extend into inner sides of the casing and the hook portions 51 exposed out of the upper and lower covers 3, 4. The resilient arms 54 of the latch members 5 bias against the enforcement plate 7, the springs 59 opposite to the resilient arms 54 are supported by the inclined projections. When the first connector unit 1 is going to mate/unmate the mating connector, the operating portions 64 are pressed and the main portions 61 inwardly deflect the retention portion 53, thereby rendering the hook portion 51 to enter into/withdraw from the mating connector and allowing the mating/unmating occurs.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first connector unit adapted for mating with a complement connector along a front-to-rear direction and comprising a first insulative housing, a first metal shielding covering the first housing and a first conductive terminal set receiving in the housing;

a second connector unit adapted for mating with another complement connector along said front-to-rear direction and electrically connected with the first connector unit and comprising a second insulative housing, a second metal shielding covering the second housing and a second conductive terminal set receiving in the housing;

a PCB, both ends of the PCB respectively connect with the first and second terminal set; and an insulative casing covering said first and second connector units and consisting of an upper cover and a lower cover engaged with each other, said casing forming a plurality of slices extending along the up-to-lower direction and a plurality of slots adapted for receiving said slices to joint the upper and lower covers together; wherein inner surfaces of the upper and lower covers are gilt with a thin metal layer, and the inner gilt surfaces of the upper and lower covers and the first and second metal shieldings define together a shielded and generally close space to cover the first and second housings.

2. The electrical connector assembly as described in claim 1, wherein each of the upper and lower covers comprises a main wall and a pair of partitions perpendicular to the main wall to hold the PCB, and inner surfaces of the main walls and partitions are gilt.

3. The electrical connector assembly as described in claim 2, wherein a distance between the pair of partitions of the lower cover is larger than that of the pair of partitions of the upper cover, and the PCB is received between the pair of partitions of the lower cover and locate on a top surface of the pair of partitions of the upper cover.

4. The electrical connector assembly as described in claim 3, wherein a plurality of bars are formed on the inner surfaces of the partitions to interfere with and hold the PCB.

5. The electrical connector assembly as described in claim 1, wherein said thin metal layer comprises a plating copper layer and a stainless steel layer covering said plating copper layer.

6. The electrical connector assembly as described in claim 5, wherein said upper cover, the second connector unit, and said lower cover each respectively form at least one through-hole, and said through-hole array in a line along said front-to-rear direction to receive at least one bolt for holding said upper cover, said second connector unit and said lower cover.

7. The electrical connector assembly as described in claim 6, wherein said second metal shielding comprises a cylindrical tube affixed to inner surface of said through-hole of the second connector unit and adapted for communicating with the bolt and the second metal shielding.

8. The electrical connector assembly as described in claim 7, wherein said second insulative housing comprises a longitudinal body and a tongue portion forwards extending from the longitudinal body, and said second metal shielding comprises a blade plate covering a front surface of said longitudinal body and a mating skeleton adapted to enclose the tongue portion.

9. The electrical connector assembly as described in claim 5, wherein the first insulative housing forming a longitudinal base wider than other portion thereof, and the upper and lower covers respectively protrude a pair of shoulder portions for commonly securing said longitudinal base.

10. The electrical connector assembly as described in claim 1, wherein the first and second connector unit have different interfaces.

11. The electrical connector assembly as described in claim 1, wherein the upper and lower covers respectively define a pair of notches on opposite sides thereof for holding a pair of fastening members.

* * * * *